US008671495B2

(12) United States Patent
Martin et al.

(10) Patent No.: US 8,671,495 B2
(45) Date of Patent: Mar. 18, 2014

(54) SCRAPER PIG

(75) Inventors: Herbert Martin, Weinstadt (DE); Werner Schwager, Ludwigsburg (DE); Martin Stiegler, Steinheim (DE); Andreas Collmer, Vaihingen (DE); Manfred Michelfelder, Höpfigheim (DE)

(73) Assignee: Durr Systems, Inc., Plymouth, MI (US)

( * ) Notice: Subject to any disclaimer, the term of this patent is extended or adjusted under 35 U.S.C. 154(b) by 0 days.

(21) Appl. No.: 11/593,319

(22) Filed: Nov. 6, 2006

(65) Prior Publication Data

US 2008/0105199 A1 May 8, 2008

(51) Int. Cl.
*B08B 9/04* (2006.01)

(52) U.S. Cl.
USPC ..... 15/104.061; 15/104.03

(58) Field of Classification Search
USPC ..... 15/344, 347, 352, 327.7, 327.1, 415, 15/488, 392, 104.03, 104.061
See application file for complete search history.

(56) References Cited

U.S. PATENT DOCUMENTS

| | | | | |
|---|---|---|---|---|
| 1,746,733 | A | 2/1930 | Lamb | |
| 3,835,889 | A * | 9/1974 | Hyde | 138/93 |
| 3,857,132 | A | 12/1974 | Knapp et al. | |
| 3,906,576 | A * | 9/1975 | Knapp et al. | 15/104.061 |
| 4,376,135 | A | 3/1983 | Patel et al. | |
| 4,521,462 | A | 6/1985 | Smythe | |
| 4,538,316 | A * | 9/1985 | Reinhart et al. | 15/104.061 |
| 4,572,437 | A | 2/1986 | Huber et al. | |
| 4,581,525 | A | 4/1986 | Horstmann | |
| 4,589,597 | A | 5/1986 | Robisch et al. | |
| 4,638,278 | A | 1/1987 | Bullock et al. | |
| 4,653,134 | A | 3/1987 | Ando | |
| 4,684,064 | A | 8/1987 | Kwok | |
| 4,715,314 | A | 12/1987 | Ramseier et al. | |
| 4,767,603 | A * | 8/1988 | Byrd et al. | 422/119 |
| 4,852,810 | A | 8/1989 | Behr et al. | |
| 4,919,333 | A | 4/1990 | Weinstein | |
| 4,927,081 | A | 5/1990 | Kwok et al. | |
| 4,944,459 | A | 7/1990 | Watanabe et al. | |
| 4,955,960 | A | 9/1990 | Behr et al. | |
| 5,011,086 | A | 4/1991 | Sonnleitner et al. | |
| 5,035,021 | A | 7/1991 | Le Devehat | |
| 5,078,321 | A | 1/1992 | Davis et al. | |
| 5,127,125 | A | 7/1992 | Skibowski | |
| 5,294,217 | A | 3/1994 | Talacko et al. | |
| 5,300,006 | A | 4/1994 | Tanaka et al. | |
| 5,397,063 | A | 3/1995 | Weinstein | |

(Continued)

FOREIGN PATENT DOCUMENTS

| | | |
|---|---|---|
| DE | 351 12 60 A1 | 10/1986 |
| DE | 41 05 116 A1 | 8/1992 |

(Continued)

*Primary Examiner* — Robert Scruggs
(74) *Attorney, Agent, or Firm* — Bejin VanOphem & Bieneman PLC

(57) ABSTRACT

A pig traversable through a conduit to deliver a liquid, such as a coating material, having a resilient flexible, generally frustoconical sealing lip which is resiliently biased against an internal surface of the conduit and a resilient biasing member engaging and biased against an under surface of the sealing lip, biasing the sealing lip against an internal surface of the conduit. The disclosed embodiments of the resilient biasing member include annular coil springs and serpentine annular metal springs which may be U-shaped in cross-section, including a first leg received against the under surface of the sealing lip and a second leg received against the pig body portion.

27 Claims, 3 Drawing Sheets

(56) References Cited

U.S. PATENT DOCUMENTS

| | | | | |
|---|---|---|---|---|
| 5,400,456 | A * | 3/1995 | Skibowski | 15/104.061 |
| 5,622,563 | A | 4/1997 | Howe et al. | |
| 5,633,306 | A | 5/1997 | Howe et al. | |
| 5,662,278 | A | 9/1997 | Howe et al. | |
| 5,683,032 | A | 11/1997 | Braslaw et al. | |
| 5,704,977 | A | 1/1998 | Baumann et al. | |
| 5,865,380 | A | 2/1999 | Kazama et al. | |
| 6,037,010 | A | 3/2000 | Kahmann et al. | |
| 6,090,450 | A | 7/2000 | Kahmann et al. | |
| 6,249,927 | B1 | 6/2001 | Ando | |
| 6,508,610 | B2 | 1/2003 | Dietrich | |
| 6,589,348 | B2 | 7/2003 | Ott | |
| 2002/0124415 | A1 * | 9/2002 | Mizutani et al. | 30/261 |
| 2004/0163192 | A1 * | 8/2004 | Martin et al. | 15/104.061 |
| 2005/0098100 | A1 * | 5/2005 | Martin et al. | 118/679 |
| 2005/0223510 | A1 * | 10/2005 | Martin et al. | 15/104.061 |
| 2006/0254510 | A1 | 11/2006 | Martin et al. | |

FOREIGN PATENT DOCUMENTS

| | | | |
|---|---|---|---|
| DE | 43 06 800 | A1 | 9/1994 |
| DE | 43 42 128 | A1 | 6/1995 |
| DE | 196 10 588 | A1 | 9/1997 |
| DE | 197 09 988 | A1 | 10/1998 |
| DE | 197 33 531 | A1 | 2/1999 |
| DE | 197 42 588 | A1 | 4/1999 |
| DE | 198 30 029 | A1 | 1/2000 |
| DE | 199 09 369 | A1 | 9/2000 |
| DE | 199 37 425 | A1 | 3/2001 |
| DE | 100 33 986 | A1 | 1/2002 |
| DE | 100 63 234 | C1 | 7/2002 |
| DE | 101 30 173 | A1 | 1/2003 |
| EP | 0 405 075 | B1 | 6/1993 |
| EP | 0 767 005 | A1 | 4/1997 |
| EP | 0 888 825 | | 1/1999 |
| EP | 0 904 848 | A1 | 3/1999 |
| EP | 0 967 016 | A1 | 12/1999 |
| EP | 1 108 475 | A2 | 6/2001 |
| EP | 1 114 677 | A1 | 7/2001 |
| EP | 0 796 663 | B1 | 8/2001 |
| EP | 1 172 152 | A1 | 1/2002 |
| WO | WO 94/22589 | | 10/1994 |
| WO | WO 03/14229 | | 2/2003 |

* cited by examiner

SCRAPER PIG

FIELD OF THE INVENTION

This invention relates to a pig which is traversable through a conduit, particularly including a flexible conduit or line, for delivering a liquid, such as coating material, including paint, solvent or thinner, through the conduit, and scraping and cleaning the conduit. In one preferred embodiment of the scraper pig of this invention, the pig is bidirectional to traverse back and forth through the conduit.

BACKGROUND OF THE INVENTION

Pig scrapers are used in many applications, particularly including delivery of a liquid through a pipe, line or other conduit, including the delivery of coating material through a flexible conduit. Modern coating systems for the series coatings of construction parts, vehicle bodies and the like utilize pig scrapers to deliver coating material through small diameter flexible plastic conduits and simultaneously scrape and clean the conduits for delivery of different coating materials, such as different color paints, solvents, thinner and the like. Thus, it is important that the pig scraper in such applications maintain sealed contact with the internal surface of the conduit as the pig traverses through the conduit to deliver a liquid coating material and simultaneously scrape and clean the line.

The prior art includes a number of scraper pigs having a flexible frustoconical sealing lip which engages the internal surface of the conduit, cleaning the internal surface of the conduit as the pig traverses the conduit. Reference is made to co-pending application Ser. No. 11/434,411 filed May 15, 2006 of the Applicant, which discloses a pig for bi-directional movement through a conduit of a coating delivery system. The scrapper pig disclosed in this application has a generally cylindrical body portion and two thin flexible resilient frustoconical sealing lips which extend in opposite directions from the central body portion. The sealing lips are resiliently biased against an internal surface of the conduit by the resiliency of the material from which the lips are formed, driving coating material, including paint and other coating materials, solvent or thinner, through the conduit and simultaneously scraping and cleaning the internal surface of the conduit. In a preferred embodiment of the pig disclosed in the above-referenced co-pending application, the outer surface of the flexible sealing lips include a relatively sharp, self-sharpening triangular sealing edge which is resiliently biased against an internal surface of the conduit as the pig traverses back and forth through the conduit, significantly prolonging the life of the pig as further disclosed below. Reference is also made to copending application Ser. No. 11/434,421 filed May 15, 2006 also assigned to the assignee of this application which discloses an alternative embodiment of a scraper pig. The disclosures of both above referenced copending applications are incorporated herein by reference.

However, there has been a long felt need in this art for an improvement in the sealing and scraping action of pigs having flexible sealing lips which is met by the scraper pig of this invention.

SUMMARY OF THE INVENTION

As set forth above, this invention relates to a pig which is traversable through a conduit for delivering a liquid, such as a coating material, through the conduit and simultaneously scraping and cleaning the conduit, sometimes referred to herein as a scraper pig. In a preferred embodiment, the pig includes a pig body, a resilient flexible generally frustoconical sealing lip extending from the pig body and surrounding the pig body having a major diameter greater than an internal diameter of the conduit in a rest position, such that the sealing lip bends or resiliently flexes radially inwardly into an operating position within the conduit to engage the inner surface of the conduit. The scraper pig of this invention further includes a resilient biasing member engaging and resiliently biased against an under surface of the sealing lip opposite the pig body, resiliently biasing a free end of the sealing lip against the internal surface of the conduit in the operating position. The resilient biasing member of the scraper pig of this invention thus maintains sealed contact between the sealing lip and an internal surface of the conduit.

In one preferred embodiment, the resilient biasing member is a spring, such as a metal spring, although a memory plastic may also be utilized, which may also be characterized as a spring.

Although any type of spring may be utilized which is resiliently biased against an under surface or an underside of the sealing lip and which resiliently biases the sealing lip against an internal surface of the conduit, this application discloses three exemplary or alternative spring designs which may be utilized for the resilient biasing member. In a first embodiment, the resilient biasing member is an annular coil spring which is U-shaped in cross-section, wherein one leg of the U-shaped coil spring is received around the body portion and the other leg is biased against the underside of the resilient flexible sealing lip. In a second embodiment, the spring is formed from a resilient metal sheet which is bent into an annular U-shape in cross-section, wherein one leg is received around the body portion and the second leg is received and biased against the underside of the resilient flexible lip as described above. In this second embodiment, the spring is serpentine or generally sinusoidal to control the force generated by the spring against the underside or under surface of the sealing lip. In a third embodiment, the spring is also a coil spring, but is round in cross-section. In each of the disclosed embodiments, the body portion includes an annular rib which retains the spring in the desired location and prevents the spring from being inadvertently removed. However, as set forth above, the resiliently biasing member or spring used in the scraper pig of this invention is not limited to the disclosed embodiments.

In one preferred embodiment of the scraper pig of this invention, the outer surface of the resilient flexible sealing lip includes a triangular sealing edge having a sharp apex which is resiliently biased against the internal surface of the conduit by the resilient biasing member. As set forth in the above-referenced co-pending application Ser. No. 11/434,421 of the Applicant and discussed further below, this triangular sealing edge is self-sharpening, maintaining sealed contact between the triangular sealing edge and the internal surface of the conduit, particularly in combination with the resilient biasing member of this invention. In one preferred embodiment of the scraper pig of this invention, particularly suitable for bi-directional movement of the pig back and forth through the conduit, the pig includes two flexible sealing lips separated from each other along a longitudinal axis of the body portion, extending in opposite directions, and resilient biasing members resiliently biased against an under surface of the sealing lips opposite the body portion, resiliently biasing the sealing lips against the internal surface of the conduit and maintaining sealed contact between the sealing lips and the internal surface of the conduit as the pig traverses back and forth through the conduit. In one preferred embodiment of this pig, the sealing lips each include a V-shaped outer surface, including a relatively sharp sealing apex and the sharp sealing apex is resiliently biased against the internal surface of the conduit by the resilient biasing members. In one preferred embodiment, the body portion includes an annular bead inboard of the sealing lips which protects the sealing lips as the pig traverses turns in the conduit, particularly sharp radii in the flexible conduit.

The scraper pig of this invention thus fulfills the long felt need in this art for improvement in the sealing and scraping action of pigs having flexible sealing lips. Other advantages and meritorious features of the scraper pig of this invention will be more fully understood from the following description of the preferred embodiments, the appended claims and the drawings, a brief description of which follows.

DESCRIPTION OF THE PREFERRED EMBODIMENTS

As set forth above, the pig or scraper pig of this invention includes a resilient biasing member which resiliently biases the sealing lip of the scraper pig against an internal surface of a conduit delivering a liquid, such as a coating material, including paint, solvent or thinner through the conduit and simultaneously scraping and cleaning the conduit. The scraper pig of this invention thus has improved performance and fulfills the long felt need for an improvement in the sealing and scraping action of pigs having flexible sealing lips. However, the pig of this invention is not limited to the disclosed embodiments and various modifications may be made within the purview of the appended claims.

Figure 1:
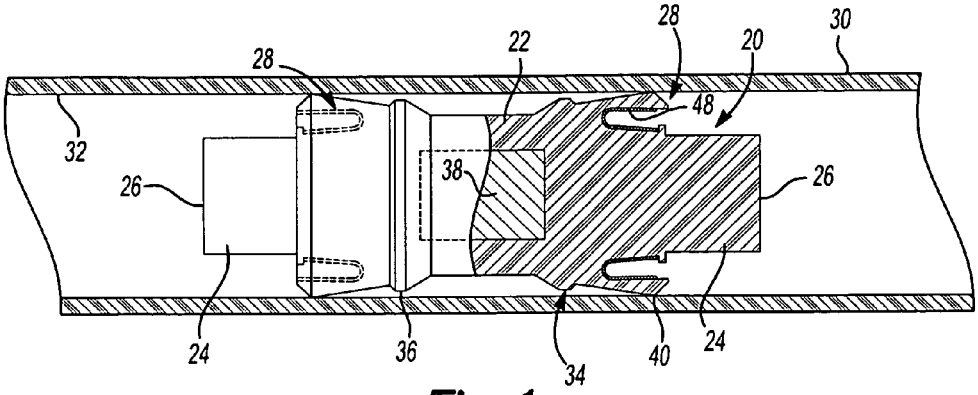
FIG. 1 is a side partially cross-sectioned view of one embodiment of the scraper pig of this invention in a conduit.

The scraper pig 20 shown in FIG. 1 includes a central body portion 22 having cylindrical end portions 24, each having a flat end face 26, and resilient flexible, generally frustoconical annular sealing lips 28. In the disclosed embodiment of the pig 20, the sealing lips 28 are integral with the body portion 22 and extend in opposite directions, such that the pig 20 is bidirectional. As set forth above, the pig 20 is traversable through a conduit 30 to deliver a liquid, such as a coating material, through the line 30 and simultaneously clean and scrape the internal surface 32 of the conduit 30. In modern paint application systems, the conduit 30 is flexible, typically formed from a flexible plastic having a small diameter and the pig must traverse the length of the conduit, which may be 50 feet in length or more in a few seconds. In a preferred embodiment, the scraper pig is integrally formed of a plastic having a low percentage of plastic deformation that exhibits both low friction and elastic deformation behavior. The pig may be integrally formed from polyethylene or other plastics including polytetrafluoroethylene, polypropylene, polyamide, polyurethane, polymethyl methacrylate, polyvinyl chloride, polycarbonate, polyoxymethylene, polystyrene or combinations of these plastic materials.

As set forth above, one preferred embodiment of the scraper pig of this invention is bidirectional. That is, the pig is adapted for movement back and forth through the flexible conduit 30. The pig must also provide a perfect seal for slow movement (e.g., less than 1 m/s) and the pig must guarantee complete evacuation of the conduit or line through residue-free scraping of fluid from the conduit walls. It is further essential that a pig with flexible sealing lips adjust automatically to the more or less tolerance-restricted inner diameter of the conduit and easily overcome unevenness and small obstacles. A preferred embodiment of the scraper pig 20 includes annular protuberances 34 extending from the central body portion 22, located inboard of the sealing lips 28 as best shown in FIG. 1. The annular protuberances each include a flat outer surface 36 and the annular protuberances protect the frustoconical sealing lips, particularly as the pig traverses sharp radii in the flexible conduit 30. The pig 20 may also include a magnetic element 38, which is used in a coating system for reporting the appearance or location of a pig at a defined position or a valve station or the like.

Figure 2:
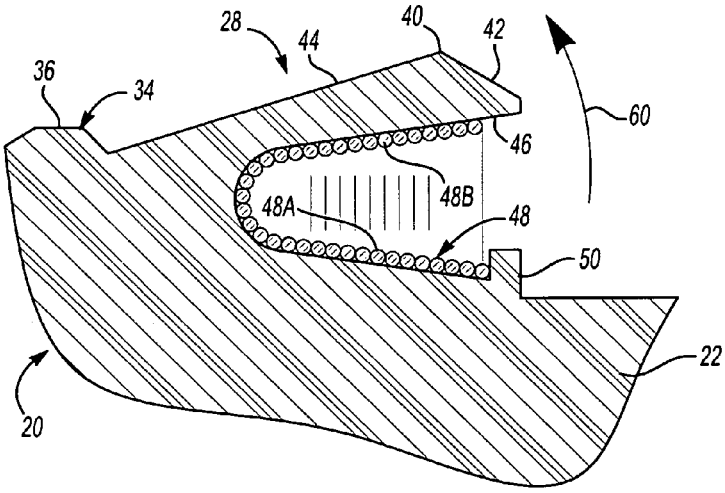
FIG. 2 is an enlarged partial side cross-sectional view of the sealing lip of the pig shown in FIG. 1.

In one preferred embodiment of the scraper pig 20 of this invention, the outer surfaces of the resilient flexible sealing lips 28 include a triangular sealing edge having a relatively sharp apex 40 defined by the adjacent flat surfaces 42 and 44 shown in FIG. 2. The leading surface 42 defines an angle of about 30 degrees relative to the inner or under surface 46 of the sealing lip 28 and the other surface 44 defines an angle of about 10 degrees relative to the under surface 46 of the sealing lip 28. As described in the above-referenced co-pending application Ser. No. 11/434,421 filed May 15, 2006, the apex 40 of the triangular sealing edge is constantly and automatically resharpened as the pig traverses back and forth through the conduit 30, significantly increasing the service life of the scraper pig. During tests, it was determined that after more than 10,000 cycles in a typical line section of a coating system, the original sealing edge 40 and the two adjacent, essentially flat surfaces 42 and 44 were still present and merely the location of the sealing edge corresponding to the wear of the surface part pressed against the inner line wall had been shifted.

Figure 3:
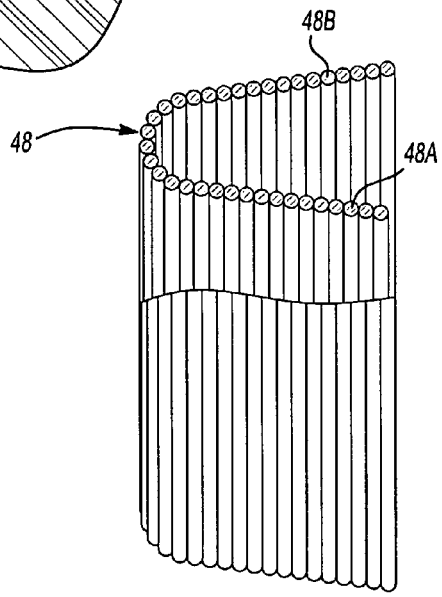
FIG. 3 is a partial side cross-sectional view of the spring of the pig disclosed in FIGS. 1 and 2.
Figure 4:
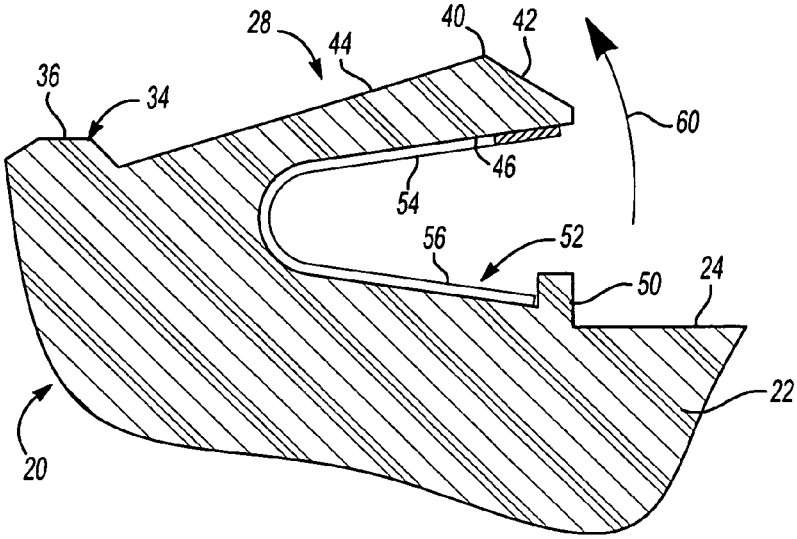
FIG. 4 is a partial side cross-sectional view similar to FIG. 2 with an alternative embodiment of the spring.
Figure 5:
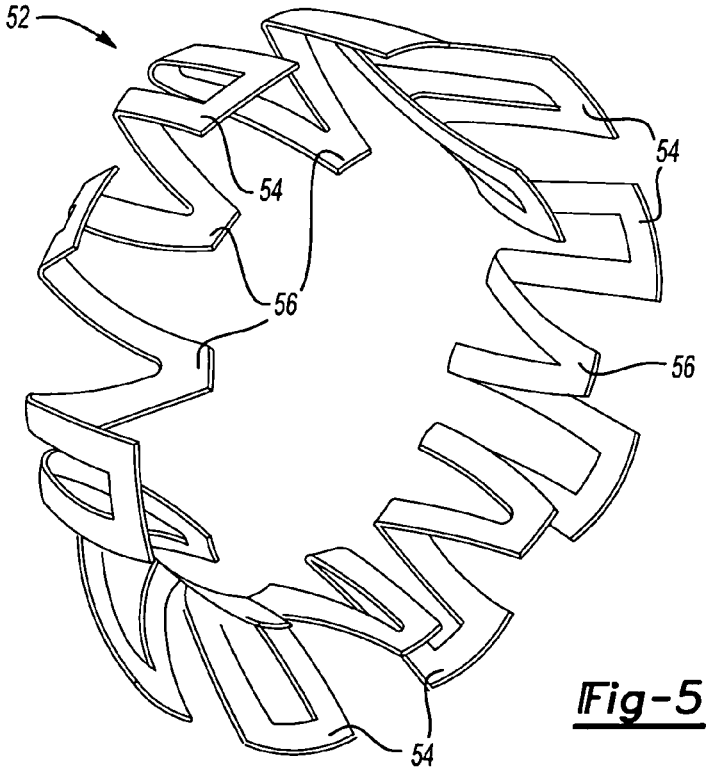
FIG. 5 is an end perspective view of the spring shown in FIG. 4.
Figure 6:
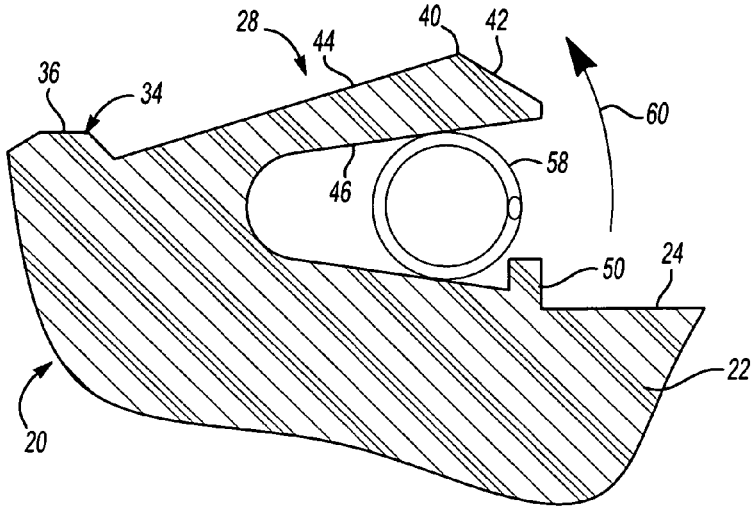
FIG. 6 is a partial side cross-sectional view similar to FIGS. 2 and 4 with an alternative embodiment of the spring.
Figure 7:
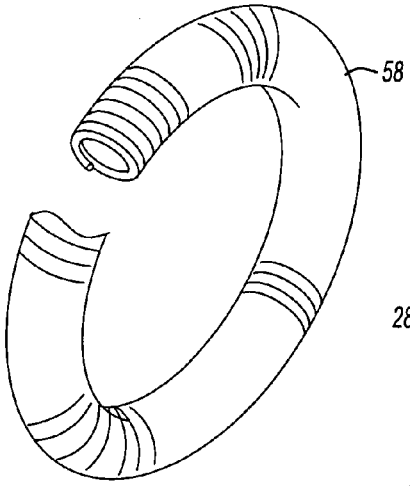
FIG. 7 is a an end perspective view of the spring shown in FIG. 6.
Figure 8:
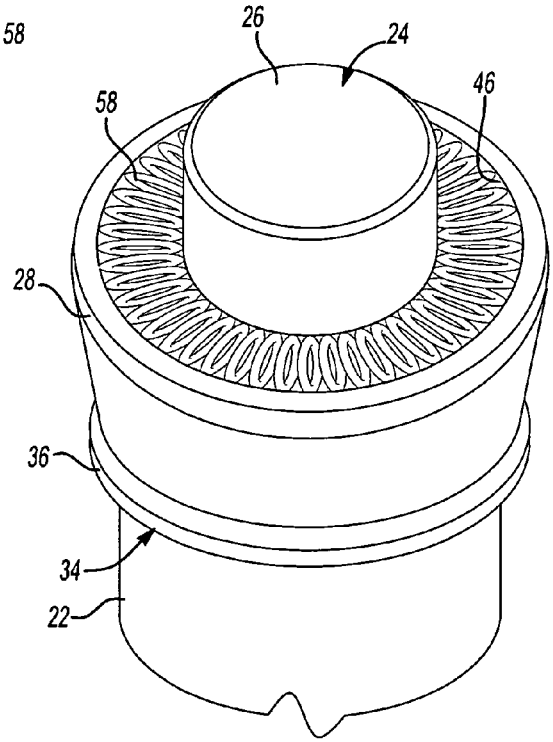
FIG. 8 is an end view of the pig shown in FIG. 1 with the spring shown in FIGS. 6 and 7.

As set forth above, the scraper pig of this invention includes a resilient biasing member engaging and resiliently biased against the under surface 46 of the sealing lip 28 opposite the pig body 22. In this embodiment, the resilient biasing member is an annular coil spring 48 which is U-shaped in cross-section as best shown in FIGS. 2 and 3. The annular U-shaped coil spring 48 is resiliently biased against the under surface 46 of the sealing lips 28, which resiliently biases the apex 40 of the triangular sealing edge against the inner surface 32 of the conduit 30 as best shown in FIG. 1. The annular U-shaped coil spring 48 includes a first leg 48A which is received around the body portion 22 of the scraper pig 20, as shown in FIG. 2, and a second leg 48B engaging and resiliently biased against the under surface 46 of the sealing lip 28. In the disclosed embodiment, the body portion 22 of the scraper pig 20 includes an annular rib 50 which retains the spring 48 in the desired position and prevents inadvertent movement of the spring 48 from the desired location. The resilient biasing member 48 thus achieves the primary object of this invention, which is the improvement in the sealing and scraping action of pigs having flexible sealing lips. FIGS. 4 and 5 illustrate a second embodiment of the resilient biasing member and FIGS. 6 to 8 illustrate a third embodiment. However, as set forth above, this invention is not limited to the disclosed embodiments of the scraper pig.

The resilient biasing member or spring 52 shown in FIGS. 4 and 5 is annular, generally U-shaped in cross-section as best shown in FIG. 4 and serpentine in configuration. This embodiment of the spring 52 includes U-shaped legs 54, received against the under surface 46 of the resilient flexible, generally frustoconical sealing lips 28 and V-shaped legs 56 received around the body portion 22 of the pig 20. Thus, the legs 54 and 56 are generally U-shaped. The annular spring 52 may be formed from a sheet or thin plate of a flexible resilient metal which is cut and formed to the desired configuration shown in FIG. 5. As discussed further below, the spring force of the annular spring 52 can be tailored to the desired force against the underside 46 of the resilient sealing lips 28 by the thickness of the sheet from which the annular spring 52 is formed and the resiliency of the material. For ease of understanding and description, the pig 20 may be identical to the pig 20 disclosed in FIG. 1, wherein the resilient flexible, generally frustoconical sealing lips 28 include angularly related planar surfaces 42 and 44 having a relatively sharp apex 44 which is resiliently biased against the under surface 46 of the resilient sealing lips 28 by the resilient biasing member 52 as described above with regard to FIGS. 1 and 2.

FIGS. 6 to 8 illustrate a third embodiment of a resilient biasing member 58 which, in this embodiment, is a coil spring 58 having a circular cross-section as best shown in FIG. 6. As shown in FIGS. 6 and 8, the coil spring 58 is received around the cylindrical end portion 24 of the body portion 22, and biased against the under surface 46 of the resilient flexible sealing lips 28. In each of the embodiments of the resilient biasing members 48 in FIGS. 1 to 3, 52 in FIGS. 4 and 5 and 58 in FIGS. 6 to 8, the resilient, flexible sealing lips 28 have an outer diameter at the apex 40 greater than the internal diameter of the inner surface 32 of the conduit 30 in the rest position. However, when the scraper pig 20 is received in the flexible conduit 30, the sealing lips 28 are resiliently flexed inwardly in a radial direction into an operating position as shown in FIG. 1, wherein the relatively sharp apex 40 of the resilient flexible sealing lips is resiliently biased against the internal surface 32 of the flexible conduit 30 by the resilient biasing members. The resilient biasing member 48, 52 or 58 resiliently biases the resilient flexible sealing lips radially outwardly as shown by the arrows 60 in FIGS. 2, 4 and 6. The force against the under side or under surface 46 of the resilient flexible sealing lips 28 may be adjusted or tailored to the specific application by the material selected for the spring, the diameter of the wire forming the coil spring 48 in FIG. 3 and 58 in FIG. 7 or the thickness of the metal sheet forming the spring 52 in FIG. 5. In one preferred embodiment, the spring is formed of stainless steel to avoid contamination of the coating material transferred through the conduit 30 and to provide a reliable constant force.

As set forth above, various modifications may be made to the scraper pig of this invention within the purview of the appended claims. First, the disclosed embodiment of the scraper pig 20 is for illustrative purposes only. The resilient flexible sealing lips 28 may be integral with the body portion 22 as shown for example in FIG. 1 or separate and attached to the body portion. The scraper pig may include cylindrical end portions 24 as disclosed or the body portion may end at the radial annular rib 50. However, cylindrical end portions 24 having planar end faces 26 is preferred for scraper pigs in a paint application system where the flexible conduits 30 include a plurality of scraper pigs 20 which abut during the paint application sequence. Further, the scraper pig may include only one annular resilient flexible sealing lip 28. Finally, as set forth above, the preferred resilient biasing member will depend upon several factors, including the application. The resilient biasing member may be a spring, such as the annular springs disclosed herein or a plastic spring formed of a memory plastic, for example, which is laminated to or received against the under surface 46 of the resilient flexible sealing lip 28.

The scraper pig of this invention thus fulfills the long felt need in this art for an improvement in the sealing and scraping action of pigs having flexible sealing lips. As set forth above, the force against the under surface 46 of the lip by the resilient biasing member may be adjusted or tailored to the particular application.

The invention claimed is:

1. A pig traversable through a conduit delivering a liquid, comprising:

a pig body being integrally formed;

a resilient flexible generally frustoconical sealing lip extending from said pig body and having a leading frustoconical wall extending rearward from a distal end of said sealing lip increasing in thickness toward an apex of said sealing lip, said distal end of the sealing lip forming an angle with the leading frustoconical wall, the sealing lip further having a following surface defining a following frustoconical wall extending rearward from said apex to an annular protuberance, said following surface defined by a substantially straight line in an axial direction along a surface of the pig body from said apex to a location at which said following wall mates to said annular protuberance, said sealing lip surrounding said pig body and having a major diameter greater than an internal diameter of the conduit;

said annular protuberance extending from said body portion radially outwardly inboard of said sealing lip thereby protecting said sealing lip.

2. The pig as defined in claim 1, further comprising a resilient biasing member engaging and resiliently biased against an under surface of said sealing lip opposite said pig body resiliently biasing a free end of said sealing lip against an internal surface of said conduit, said sealing lip being self-sharpening when said pig is traversable in two directions thereby extending the life of said pig body.

3. The pig as defined in claim 2, wherein said biasing member is a spring.

4. The pig as defined in claim 3, wherein said spring is a coil spring.

5. The pig as defined in claim 2, wherein said resilient biasing member is resiliently biased against said pig body.

6. The pig as defined in claim 2, wherein said resilient biasing member is a spring biased against said pig body and against said under surface of said sealing lip.

7. The pig as defined in claim 6, wherein said spring is an annular coil spring.

8. The pig as defined in claim 7, wherein said coil spring is round in cross-section.

9. The pig as defined in claim 2, wherein said resilient biasing member is an annular spring which is U-shaped in cross-section, including a first leg received around said pig body and a second angularly related leg received and biased against said underside of said sealing lip.

10. The pig as defined in claim 9, wherein said pig body includes an annular projecting stop and said first leg of said annular coil spring is received against said annular projecting stop.

11. The pig as defined in claim 2, wherein said resilient biasing member is a serpentine annular metal spring which is U-shaped in cross-section.

12. The pig as defined in claim 2, wherein said biasing member is a spring formed from a resilient metal sheet, which is bent into an annular U-shape in cross-section.

13. The pig as defined in claim 12, wherein said spring is serpentine having generally U-shaped legs.

14. The pig as defined in claim 2, wherein said sealing lip includes a V-shaped outer surface having a relatively sharp sealing apex and said resilient biasing member resiliently biasing said relatively sharp apex of said sealing lip against an internal surface of the conduit, maintaining sealed contact between said sealing apex and an internal surface of the conduit.

15. The pig as defined in claim 1, wherein said annular protuberance includes a flat outer surface that is substantially parallel to an axis of said pig body.

16. A pig for delivering a coating material through a conduit, said pig comprising:

a body portion being integrally formed;

a thin resilient flexible annular sealing lip extending from said body portion, the sealing lip having a major diameter greater than an internal diameter of the conduit, said annular sealing lip defining a leading surface shaped as a leading frustoconical wall extending from a distal end of said sealing lip to another surface defining an other frustoconical wall, said distal end of the sealing lip forming an angle with the leading frustoconical wall, said surfaces meeting to define an apex of said sealing lip so that said annular sealing lip increases in thickness toward said apex of said sealing lip, and said leading surface defining a substantially obtuse angle with said other surface, with said other frustoconical wall defined by a substantially straight line in an axial direction along a surface of the body portion from said apex to a location at which said other surface mates to an annular protuberance extending from said body portion radially outwardly inboard of said sealing lip thereby protecting said sealing lip; and said following frustoconical wall defined said annular protuberance.

17. The pig as defined in claim 16, further comprising a spring resiliently biased against an underside of said sealing lip biasing said sealing lip radially against an internal surface of the conduit and maintaining sealed contact between said sealing lip and an internal surface of the conduit, said sealing lip being self-sharpening when said pig is traversable in two directions thereby extending the life of said pig body.

18. The pig as defined in claim 17, wherein said spring is a coil spring resiliently biased against said sealing lip.

19. The pig as defined in claim 18, wherein said coil spring is round in cross-section.

20. The pig as defined in claim 18, wherein said coil spring is U-shaped in cross-section.

21. The pig as defined in claim 17, wherein said sealing lip is integral with said body portion surrounding said body portion and said spring is biased against an underside of said sealing lip opposite said body portion.

22. The pig as defined in claim 17, wherein said spring is an annular spring having a U-shaped cross-section.

23. The pig as defined in claim 17, wherein said spring is U-shaped in cross-section and includes a first leg received around said body portion and a second angularly related leg received and biased against said underside of said sealing lip.

24. The pig as defined in claim 17, wherein said spring is a serpentine annular spring which is U-shaped in cross-section.

25. The pig as defined in claim 17, wherein said spring is formed from a resilient metal sheet which is formed into an annular U-shape in cross-section.

26. The pig as defined in claim 17, wherein said sealing lip includes a V-shaped outer surface having a relatively sharp sealing apex and said spring resiliently biases said relatively sharp apex of said sealing lip against an internal surface of the conduit and said body portion includes annular protuberances adjacent an inner end of said sealing lips.

27. The pig as defined in claim 16, wherein said annular protuberance includes a flat outer surface that is substantially parallel to an axis of said pig body.

* * * * *